United States Patent [19]

Gunnerman

[11] 4,249,471

[45] Feb. 10, 1981

[54] METHOD AND APPARATUS FOR BURNING PELLETIZED ORGANIC FIBROUS FUEL

[76] Inventor: Rudolf W. Gunnerman, 1500 Valley River Dr., Ste. 220, Eugene, Oreg. 97401

[21] Appl. No.: 7,171

[22] Filed: Jan. 29, 1979

[51] Int. Cl.[3] ..... F23G 5/00

[52] U.S. Cl. ..... 110/243; 110/244; 110/261; 110/106

[58] Field of Search ..... 110/243, 244, 260-262, 110/106

[56] References Cited

U.S. PATENT DOCUMENTS

| | | | |
|---|---|---|---|
| 1,468,008 | 9/1923 | Dyson | 110/261 |
| 1,628,609 | 5/1927 | Newhouse | 110/106 |
| 1,726,870 | 9/1929 | Trent | 110/261 |
| 2,550,390 | 4/1951 | Stephanoff | 110/106 |
| 3,393,650 | 7/1968 | Daman et al. | 110/261 |
| 3,472,185 | 10/1969 | Burden, Jr. | 110/244 |
| 3,500,775 | 3/1970 | Hubbard | 110/244 |
| 3,889,608 | 6/1975 | Pitt | 110/244 |

*Primary Examiner*—Henry C. Yuen

*Attorney, Agent, or Firm*—Stevens, Davis, Miller & Mosher

[57] ABSTRACT

An apparatus and method are described for producing a combustible mixture of a solid fuel pellet made from organic fibrous material and a flammable gas or liquid. A suitable burner structure is described for burning the fuel mixture in an overfire system efficiently and producing a minimum of solid combustion products as ash. The flammable gas mixed with the solid fuel material may be made by burning pellets of an organic fibrous material.

2 Claims, 2 Drawing Figures

METHOD AND APPARATUS FOR BURNING PELLETIZED ORGANIC FIBROUS FUEL

BACKGROUND OF INVENTION

The subject matter of this application relates to the burning of a solid pelletized organic fibrous material. Specifically, apparatus and method are provided whereby pelletized biomass particles are combined with a flammable gas or liquid to provide a combustible mixture for producing a flame with minimum fuel consumption.

Fuel pellets made from fibrous organic material have recently become available as a source of energy for heaters, furnaces and other devices which require the production of a flame efficiently and cleanly whereby a minimum amount of pollutants and solid ash is produced. Fuel pellets according to the foregoing are described in my U.S. Pat. No. 4,015,951 entitled "Fuel Pellets And Method For Making Them From Organic Fibrous Materials". The above mentioned reference describes a commercially successful technique for producing a fuel from organic fibers such as saw dust in the form of pellets. The fuel produced by the disclosed process yields 8500 to 9000 BTU or more per pound of pellets making the fuel a viable alternative to other solid fuels.

The pellets produced from the technique described in the aforementioned patent can also be gasified to produce a gas which is combustible as disclosed in my copending applications entitled "Process for Gasifying Organic Fibrous Material and the Product Thereof", Ser. No. 813,453, filed July 7, 1977, and "Process for Gasifying Organic Fibrous Material and the Product Thereof", Ser. No. 931,292, filed Aug. 4, 1978. Gasified pellets can yield additional fuel efficiency, being able to generate heat at a level of 11,800 BTU's per pound. The present invention relates to burning both solid pellet fuel made from fibrous organic material and a flammable liquid or gas simultaneously. The solid fuel may be ground fuel pellets of the type disclosed in my aforesaid patent.

SUMMARY OF THE INVENTION

It is a primary object of this invention to provide an apparatus and method for burning solid pelletized organic fibrous material in a manner to produce a flame at an efficient fuel consumption rate and which produces a minimum of combustion by-products. Another object of the invention is to provide an apparatus and method for increasing the heat energy produced when burning a combustible mixture containing pelletized fibrous materials.

These and other objects of the invention are provided by grinding solid fuel to a miximum of one sixteenth of an inch particle size and mixing the ground particles with a fluid fuel which may be either liquid or gaseous for combustion. The ground particles are formed in a stream by a blower and introduced tangentially to a fluid fuel stream whereby the fluid, ground particles, and air are mixed. The resulting mixture is diffused into a confinement cylinder whereby ignition may be instituted by an igniter or other suitable means located within the confinement cylinder.

In one embodiment of the invention, a mixture of fluid fuel and air, and pulverized pellets of organic fibrous material is directed to a diffuser located in front of the confinement cylinder. The base of the diffuser located in front of the confinement cylinder is tapered parabolically to a point opposite the entering mixture. Means are provided to direct the diffused mixture into the cylinder whereby ignition may take place by means of an igniter located therein. The diffuser of this embodiment in combination with the confinement cylinder provides a controlled combustion for efficiently burning the mixture of gas or liquid fuel and pulverized pellets.

DESCRIPTION OF THE PREFERRED EMBODIMENT

Figure 1:
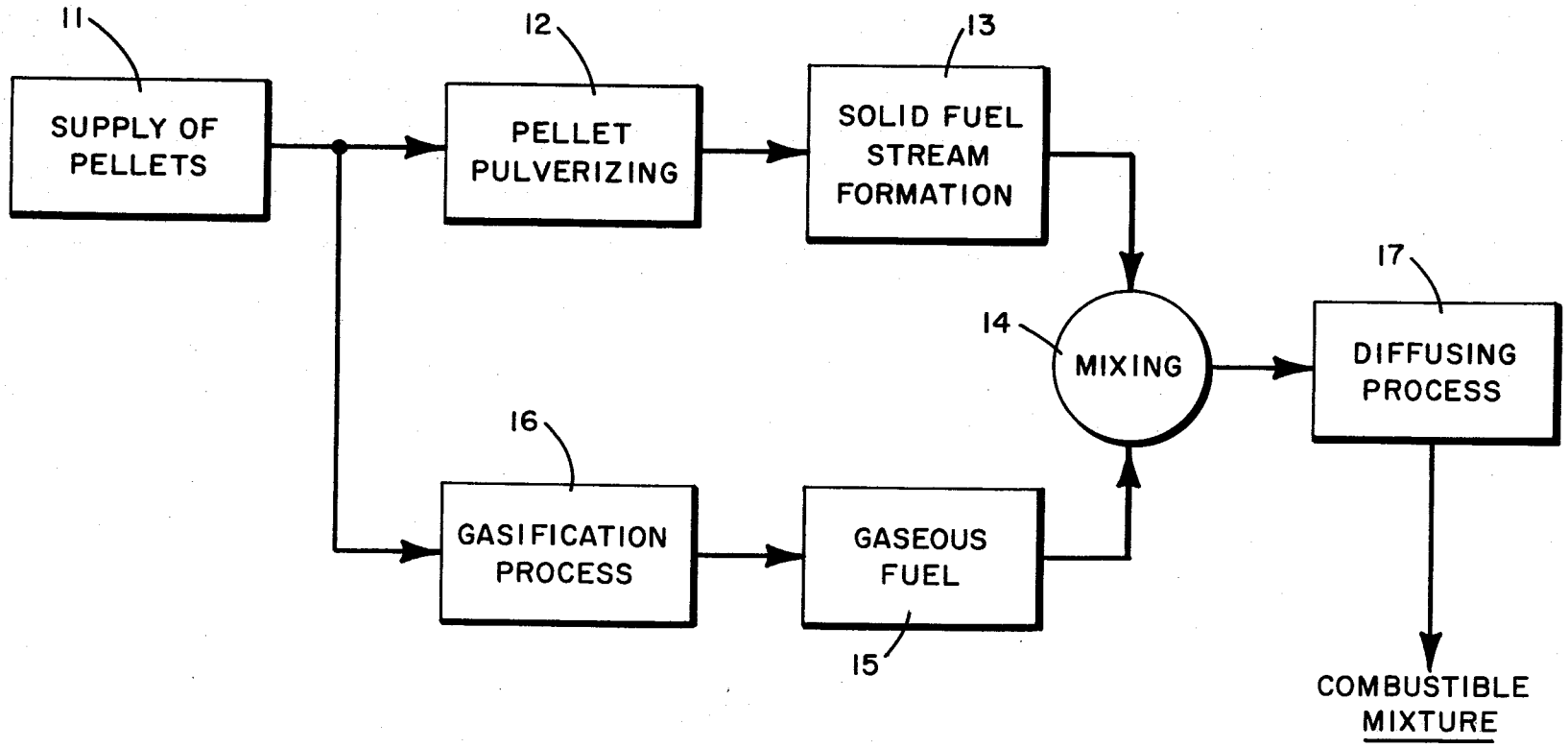
FIG. 1 illustrates a flow diagram illustrating the process for generating a combustible mixture of fuel.

Referring now to FIG. 1, there is shown diagrammatically the process for generating a combustible fuel mixture in accordance with one embodiment of the invention. A supply of pellets 11 is indicated for providing the basic ingredient to the process, organic fibrous fuel material manufactured in accordance with the aforementioned U.S. patent, hereby incorporated by reference. The supply of pellets is pulverized by a pellet pulverizing system 12 which will provide finely ground pellets as a solid fuel substance for mixing with a flammable fluid fuel. By way of example, the preferred embodiment shall be described in accordance with a mixture of a gaseous fuel with a solid fuel substance. It is to be understood however that suitable flammable liquid may be used in place of the gaseous fuel of the preferred embodiment. The pulverized pellet material is formed into a stream of pulverized pellets 13 for introduction into a mixing process 14. The stream of pulverized pellets also contains air to aid in the combustion process.

The mixing process 14 receives pulverized pellets suspended in air and receives a gaseous fuel for mixing with the pulverized pellets. The gaseous fuel supply 15 may be from a gasification process 16 which converts pellets received from the supply of pellets 11 into a producer gas. Other flammable gas such as natural gas or propane will also work in the process.

The product from the mixing process 14 is diffused by a diffusing process 17 whereby a combustible mixture is produced which may be ignited to produce a flame.

Figure 2:
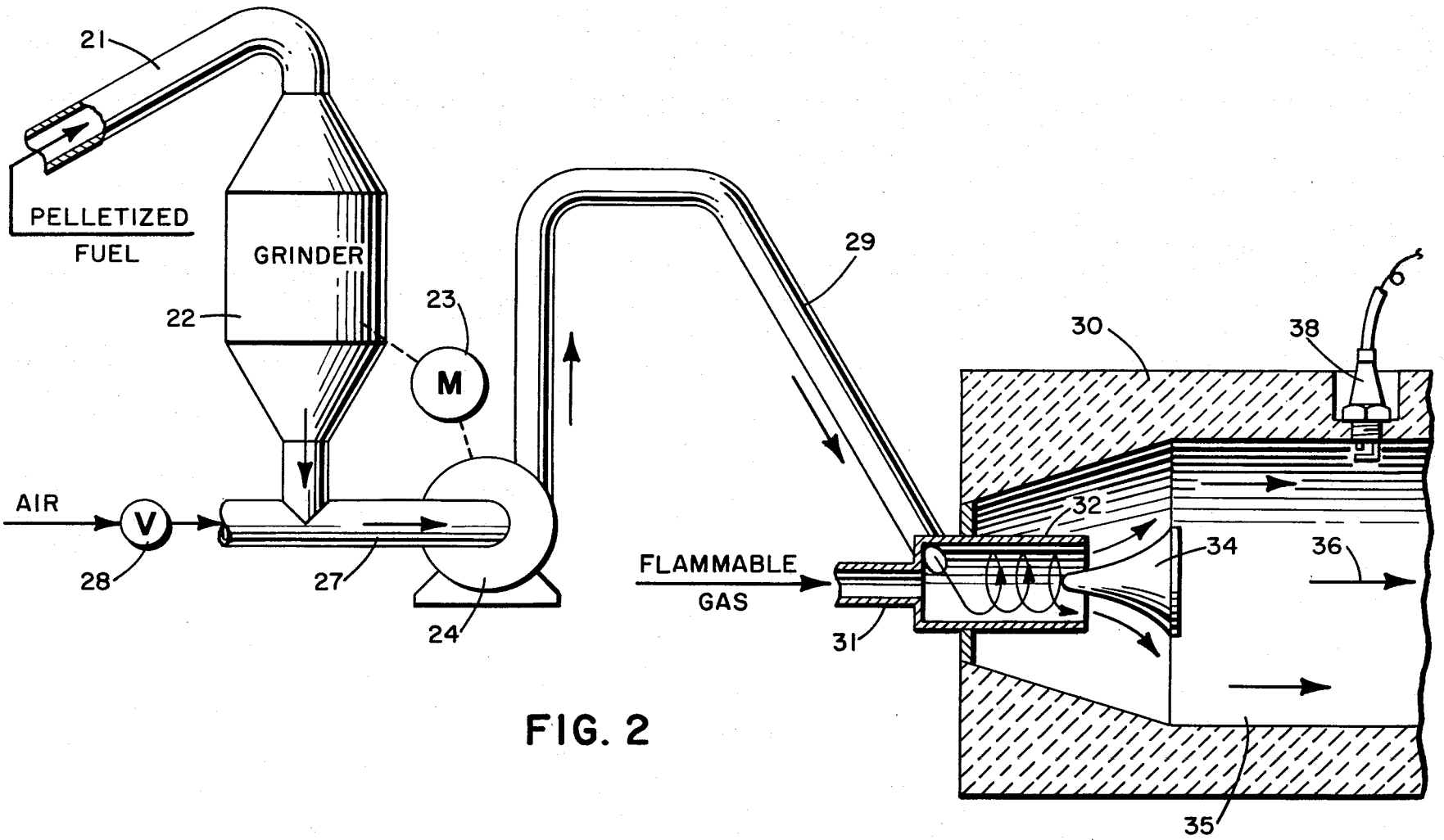
FIG. 2 illustrates apparatus for producing and burning a mixture of solid fibrous organic fuel and gas.

The process described providing the combustible mixture may be carried out in the apparatus shown in FIG. 2. Referring now to FIG. 2, there is shown a conveyor 21 suitable for bringing pelletized organic fibrous fuels into a grinder 22. The pelletized fuel, produced according to the technique of the aforementioned patent, enters grinder 22 where it is reduced in size to a particle size which is preferably less than one sixteenth of an inch. Pulverizing may be accomplished by using a hammermill grinder, known to those skilled in the art, for forcing the pellet fuel through a wire mesh of a proper size. The output from the grinder 26 is operatively connected to the blower intake 27 of blower 24. A motor 23 is drivingly connected with the grinder 22 and blower 24. The blower 24 forces the pulverized fuel into a conduit 29. The blower 24 should be capable of producing a sufficient volume of air in order to supply the required fuel rate for the combustion process. A valve 28 is located at the blower intake 27 for adjusting the amount of air to be mixed with the pulverized pellets. By selectively positioning valve 28, the fuel richness of the stream provided in conduit 29 may thereby be adjusted.

The stream of pulverized fuel contained in conduit 29 is tangentially added to gas entering a conduit 31. The mixing process of combining a gas entering conduit 31 and the solid fuel provided by conduit 29 is accomplished in a mixing channel 32. Gas entering conduit 31, which may be gasified pellets of organic fibrous material made in accordance with the teachings of my aforesaid copending applications hereby incorporated by reference, enters mixing channel 32 where the addition of the solid fuel particles causes turbulence and a mixing of solid fuel particles, air, and gas entering conduit 31. Mixing channel 32 is located through the wall of a furnace structure 30 which contains a burner suitable for igniting a mixture exiting mixing channel 32. A burn area is provided by confinement cylinder 35 located axially from the exit port of mixing channel 32. Located between the confinement cylinder 35 and mixing channel 32 is a diffuser 34. The diffuser 34 has a base section located at the entrance area of the confinement cylinder, and a tip portion located at the exit portion of mixing channel 32. In a preferred embodiment, the diffuser 34 has a surface which is parabolic in shape thus aiding in the increasing of air turbulence at the burning point and increasing the retention time of the pulverized solid fuel within the furnace volume. The confinement cylinder 35, placed even with the base of the diffuser provides heat retention in the diffused burning area and assists in the flow characteristics of the burning area. A means for directing the diffused mixture 36 is provided in order to guide the mixed diffused fuel into the burn area where a suitable igniter 38 may ignite the combustible mixture in the burn area.

In actual operation, the system acts as an overfire system whereby the heat produced is a function of the energy content of the solid fuel and the gaseous fuel. In starting such a system, another heat source may be required in order to bring the temperature up to where the overfire system will permit combustion of the fuel mixture. Additionally, another type of gas may be used in place of the organic fibrous gaseous fuel whereby an initial burning may be started, and when temperatures are sufficiently high the solid fuel from conduit 29 is then introduced into the mixing channel 32. A significant advantage of this embodiment for burning the fuel mixture is that it is a horizontal structure which provides complete combustion of the pulverized solid fuel material.

It is preferred to blow or otherwise charge ground fuel pellets of the kind described in my aforesaid patent to the flame of burning gas instead of ground sawdust or other non-pelletized organic fibrous material because results obtained so far indicate that a higher BTU is produced with such ground pellets. As described in my patent, waxes, lignin and possibly other materials are excluded from the fibrous material when it is compressed in a pellet mold as described in my patent. It may be that the concentration of such materials at the surface of the pellets is at least partially responsible for the ground pellet burning with the production of more energy than a comparable amount by weight of non-pelletized organic fibrous material although I do not want to be bound by such theory or explanation. At any rate, such pellets are ground in accordance with this invention to provide the preferred solid overfire fuel mixed with the burning gas.

Thus there has been described with respect to one embodiment, method and apparatus for producing a fuel mixture and burning the mixture to produce a flame at a maximum efficiency of fuel product and a minimum production of waste combustion products. Those skilled in the art will recognize other embodiments of the invention defined more particularly by the claims which follow.

What is claimed is:

1. An apparatus for burning simultaneously a particulate solid organic fibrous fuel and a combustible gas comprising a furnace having a housing enclosing a combustion chamber for burning said fuels, means for mixing said fuels comprising a housing supported in the combustion chamber and enclosing a space for receiving said fuels, conduit means for flowing said combustible gas axially into said mixing means, means for blowing with air said particulate fuel into said space of said mixing means tangentially to flow of said combustible gas, means comprising a vortex for turbulent flow of mixed particulate fuel, air and combustible gas from the mixing means into the combustion chamber, means for igniting the resulting mixture of fuels in the combustion chamber, and means for exhausting the resulting combustion gases from the combustion chamber, said housing enclosing a combustion chamber has a cylindrical shape and is disposed with its longitudinal axis substantially horizontal, the means for introducing the combustible gas into the mixing chamber is a first conduit connected to a source of combustible gas under pressure, and said mixing means is disposed in the combustion chamber with its axis substantially parallel to the axis of said housing enclosing the combustion chamber, the means for introducing particulate solid fuel is a second conduit associated with a source of air and connected to said mixing means at an angle whereby the air enters the tubular mixer tangent to the flow of gas from the first conduit, and the apparatus comprises means for mixing particulate solid organic fibrous material with the air in the second conduit, and means for blowing the air through the second conduit to suspend said particulate solid fuel and carry it into said mixer.

2. The apparatus of claim 1 comprising a source for pelletized organic fibrous material, and means for comminuting the pellets into particles of 1/16 inch or smaller.

* * * * *